United States Patent [19]

Eckold et al.

[11] Patent Number: 5,040,278

[45] Date of Patent: Aug. 20, 1991

[54] POWER-DRIVEN PINCER-TYPE TOOL HOLDER FOR USE IN HANDLING APPARATUSES

[76] Inventors: Gerd-Jurgen Eckold, Silberhutte 11, D-3424 St. Andreasberg; Hans Maass, Germelmannstr. 12, D-3422 Bad Lauterberg, both of Fed. Rep. of Germany

[21] Appl. No.: 650,976

[22] Filed: Feb. 1, 1991

Related U.S. Application Data

[63] Continuation-in-part of Ser. No. 466,816, Jan. 18, 1990, abandoned.

[30] Foreign Application Priority Data

Feb. 22, 1989 [DE] Fed. Rep. of Germany ..... 3905466

[51] Int. Cl.[5] ..... B23P 11/00

[52] U.S. Cl. ..... 29/243.53; 29/252

[58] Field of Search ..... 29/243.5, 243.52, 243.53, 29/252; 269/217, 229

[56] References Cited

U.S. PATENT DOCUMENTS

| | | | |
|---|---|---|---|
| 1,346,022 | 7/1920 | Hassel | 29/278 |
| 2,405,779 | 8/1946 | Davis | 29/243.53 |
| 3,579,795 | 5/1971 | Burman | 29/278 |
| 4,614,017 | 9/1986 | Eckold et al. | 29/243.53 |

*Primary Examiner*—J. J. Hartman

*Attorney, Agent, or Firm*—Townsend and Townsend

[57] ABSTRACT

A power driven tool holder for handling apparatus comprises a socket to which a plurality of pincer members are pivotally connected. Each pincer member includes a two-armed lever having a first end where a tool member may be mounted and a second end carrying a cam follower. A cam head common to all pincer members is hydraulically displaceable and is provided with cam tracks individually adapted to the desired displacement of the allocated lever whose cam follower engages the respective cam tracks.

5 Claims, 4 Drawing Sheets

POWER-DRIVEN PINCER-TYPE TOOL HOLDER FOR USE IN HANDLING APPARATUSES

The present application is a continuation-in-part of application Ser. No. 07/466,816, filed on Jan. 18, 1990, now abandoned.

BACKGROUND OF THE INVENTION

The present invention relates to a power-driven pincer-type tool holder for use in handling apparatuses.

The term "handling apparatus" designates an apparatus which performs movements under program control in a plurality of degrees of freedom. A well known example is an automatic welding apparatus for spot welding of vehicle bodies. For this purpose, the vehicle body or, more generally, the work piece is supported in a predetermined position whereby a spatial reference coordinate system is defined according to which the welding apparatus is programmed. During spot welding, two electrodes act upon the work piece with equal and counter-directed forces so that the work piece is not deformed by bending or torsional stress.

It is an object of the present invention to provide a tool holder for such handling apparatuses which permits the implementation of operations where unidirectional forces may occur.

SUMMARY OF THE INVENTION

Briefly, the invention provides a power driven tool holder comprising a socket which may be mounted in a predetermined orientation on the head of a "robot." A pincer member for each tool member to be mounted is pivotably connected to the socket and includes a two-armed lever. Each lever has a working end where the respective tool member is mounted and a drive end carrying a cam follower. A common drive cylinder displaces a common cam head which is provided with a cam track for each lever. The cam tracks are individually formed to provide the particular movement the respective tool member is expected to perform, and the cam followers and cam tracks may be held in engagement preferably by means of bias springs. Alternatively, the cam track may be formed as a groove to positively drive open and drive closed the pincer members.

A preferred embodiment is schematically illustrated in the attached drawings to which the following description refers.

DESCRIPTION OF THE SPECIFIC EMBODIMENTS

Figure 1:
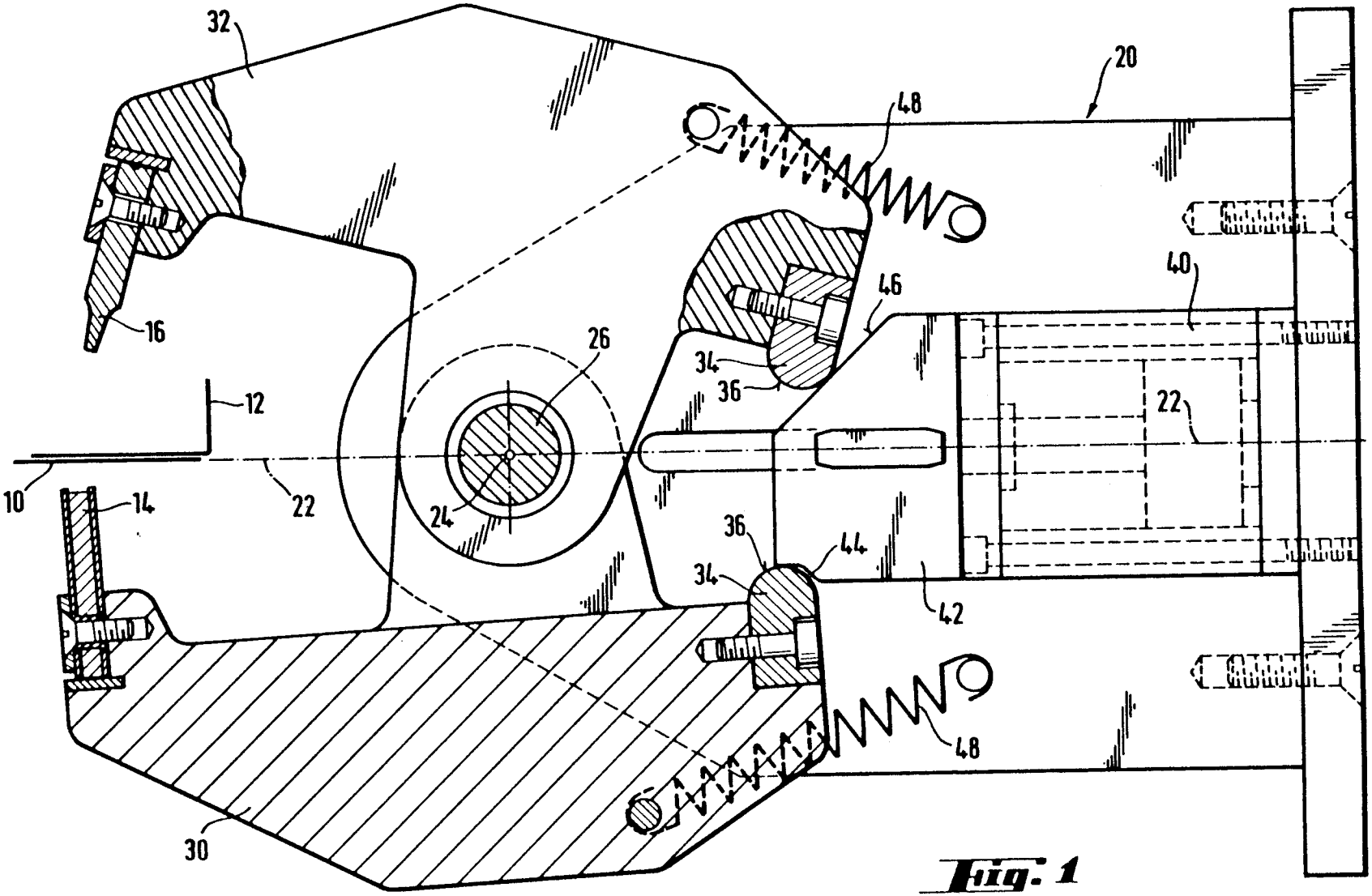
FIGS. 1 through 3 show partially in section side views of a tool holder according to the invention in three successive phases of the movements.

As an example, it is assumed that a sheet metal piece 10 is to be connected to a sheet metal bracket 12 by means of a stamp-squeeze-process as described in U.S. Pat. No. 4,614,017, the disclosure of which is incorporated herein by reference.

Briefly, the sheet metal components to be connected are supported by a female die 14 while a male die or punch 16 cuts through them from the other side and deforms the material into the female die cavity whereafter the material is squeezed to make it flow in lateral direction whereby some sort of a "rivet head" is produced. Once the joint is produced, the punch is withdrawn and the female die is released from the work piece.

The tool holder 8, subject of the present invention, comprises a socket 20 which may be mounted in a predetermined orientation on a robot head (not shown) of a handling apparatus. Once so mounted, e.g., by means of screws (not shown), the position of the socket 20 relative to the operational axes of the handling apparatus is well defined. It is assumed that the robot head may be displaced along an axis 22 and may be rotated thereabout. Upon programming, the bottom surface of sheet 10 is assumed as a reference plane into which axis 22 is to be brought, and that the socket 20 is rotated about axis 22 such that the axis 24 of a pivot 26 extends parallel to the reference plane. Programming is simplified if axis 22 and axis 24 intersect one another orthogonally, as illustrated here. It is to be noted, however, that the tool holder 8 may have a plurality of pivots whose axes are preferably parallel to one another.

Pincer members 30 and 32 are pivotably mounted about axis 24 on socket 20. Pincer member 30 carries the female die 14 while pincer member 32 carries punch 16. Each pincer member 30 and 32 comprises a two-armed lever with a first arm (to the left in FIGS. 1–3) to carry the tool member and a second arm (to the right) provided with a cam follower 34 having a rounded engagement face 36.

A drive cylinder 40, preferably a hydraulic cylinder, is mounted on socket 20. The piston of this cylinder is directly or via a piston rod connected to a cam head 42. Cam head 42 is exchangeable in order to permit adaptation of the cam head to different types of tool members to be mounted on the pincer members. Cam head 42 has as many cam tracks 44, 46 as pincer members are provided, two in the illustrated embodiment, and each pincer member has its own individual and adapted cam track. The cam followers 34 are held in engagement with the allocated cam track 44 or 46 by means of bias springs 48.

Figure 2:
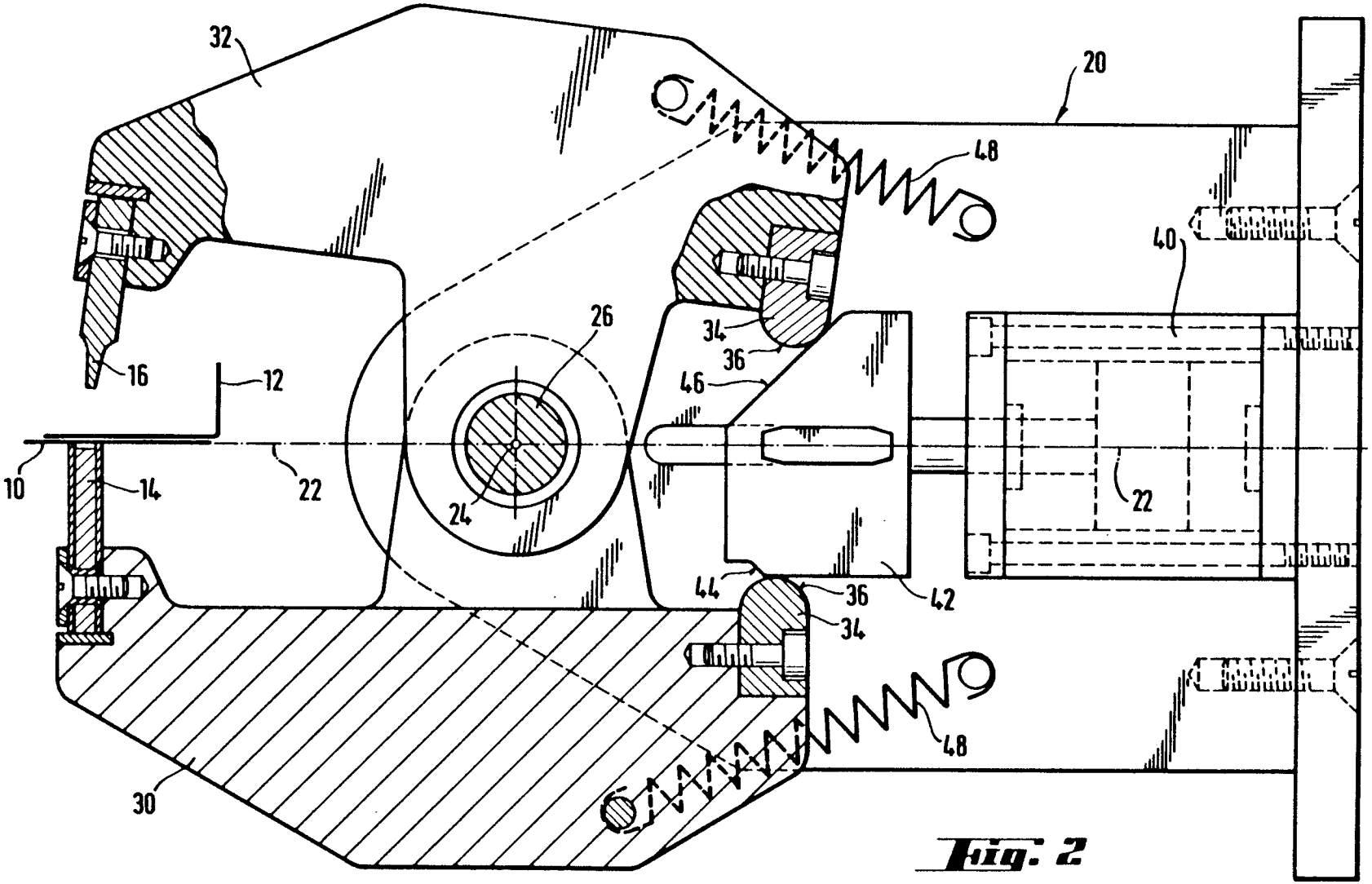
Figure 3:
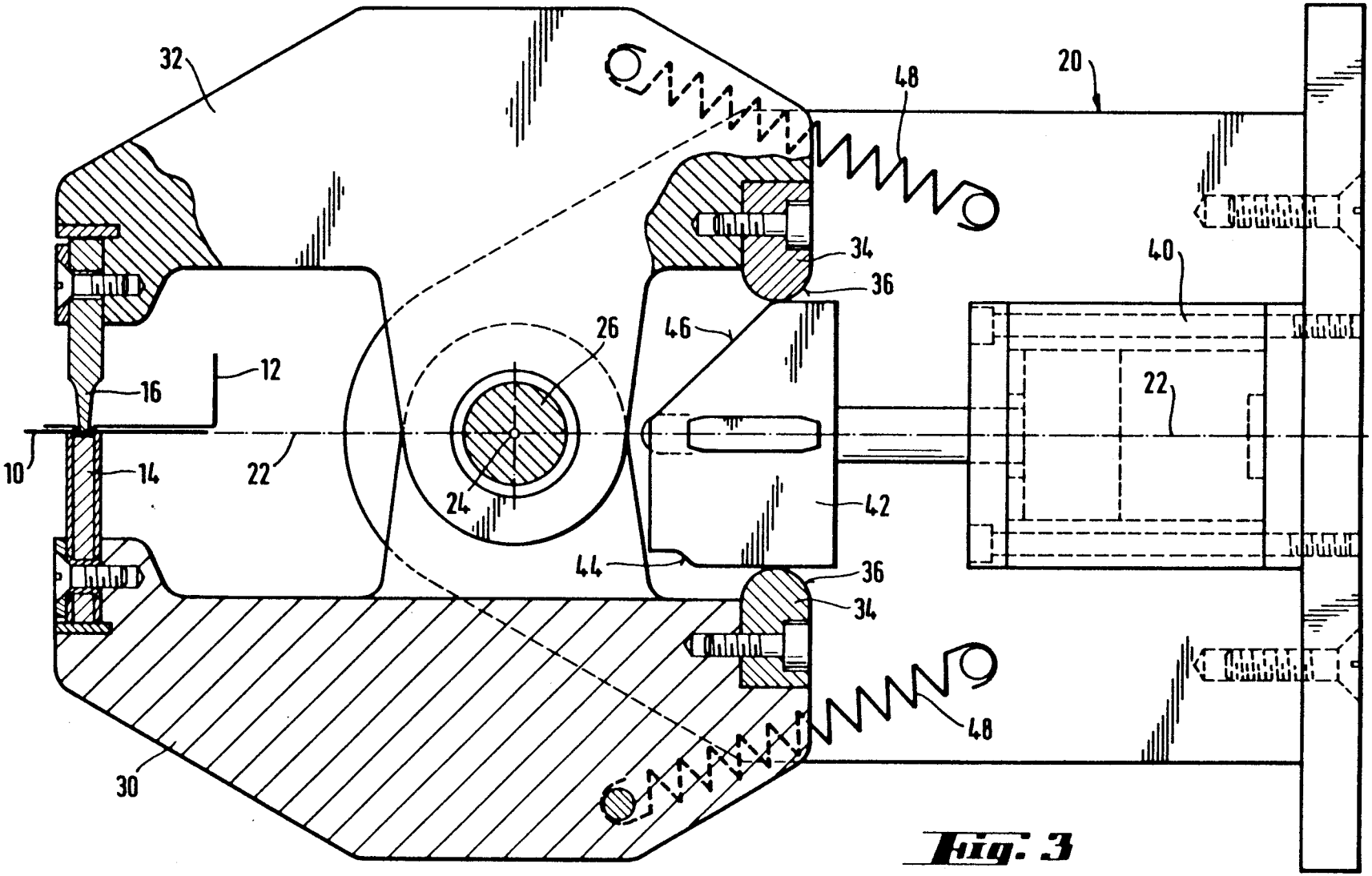

FIG. 1 shows the start position of the tool holder 8 in which the tool members 14 and 16 are spaced apart so that the tool holder may be moved along axis 22 and across bracket 12 into a desired position. Upon actuation of the drive cylinder 40, pincer member 30 is initially pivoted by means of cam track 44 into its end position in which the female die just abuts or is flush with the surface of sheet 10 facing the female die (FIG. 2). Simultaneously, punch 16 is steadily approaching bracket 12 (FIG. 2). Upon further displacement of the cam head 42, pincer member 30 with its female die 14 remains stationary as the respective portion of cam track 44 extends parallel to the reference plane defined by sheet 10. Simultaneously, cam track 46 continues to displace pincer member 32 and thus punch 16 into the position illustrated in FIG. 3 in which the joining operation is terminated. Drive cylinder 40 is now reversed, and the pincer members 30 and 32 are displaced in opposite direction under the bias of their springs 48.

It will be understood that not only two, as in the embodiment shown, but more than two pincer members may be provided and may be actuated simultaneously. For example, a third pincer member could carry an ejector element which contributes to release the work piece from female die 14. Further, the bias springs 48 would be unnecessary if the cam tracks were able to guide the cam followers in channel-like grooves in order to positively open and close the pincer members.

Figure 4:
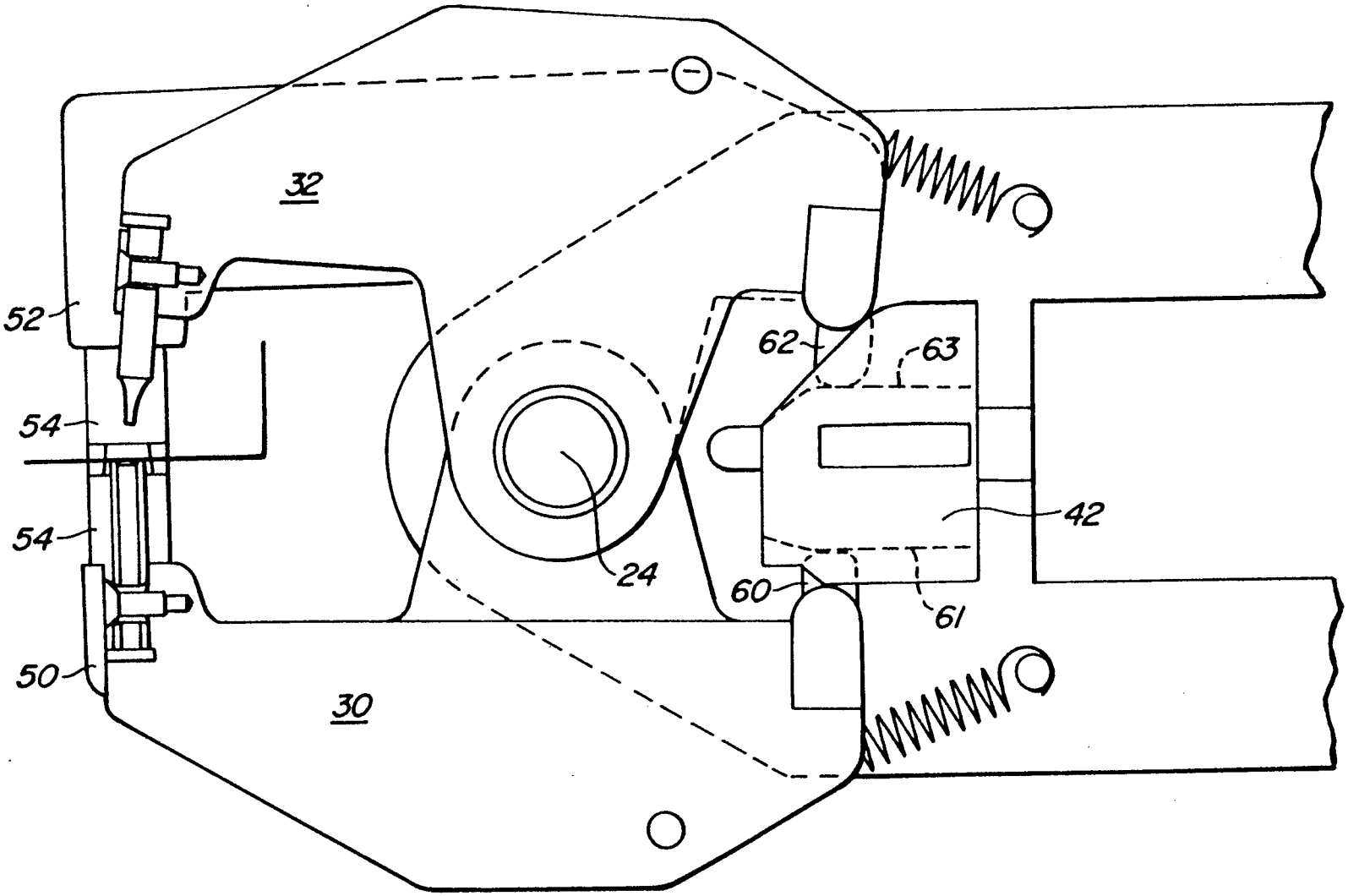
FIG. 4 illustrates a preferred embodiment of the tool holder of the present invention shown in plan view similar to FIGS. 1 through 3.

FIG. 4 illustrates a modified and preferred embodiment of the tool holder of the present invention. Two additional pincer members 50 and 52 are pivotably mounted about axis 24. Each of the pincer members 50 and 52 carries a gallon holder 54 engaging the workpiece prior to actuation of pincer members 30 and 32 for connecting the workpiece. The position of pincer members 30 and 32 is similar to that shown in FIG. 2.

Each pincer member 50 and 52 also have the cam follower 60 and 62, respectively, in engagement with an allocated cam track 61 and 63, respectively. These cam tracks 61 and 63 are on the head cam 42 which also carries cam surfaces 44 and 46. Cam tracks 61 and 63, however, are not coincident with cam tracks 40 and 46, but instead define an angular displacement of pincer members 50 and 52 for a quick engagement of the workpiece followed by continued support thereof during the remainder of the actuation of pincer members 30 and 32.

Although the foregoing invention has been described in detail for purposes of clarity of understanding, it will be obvious that certain modifications may be practiced within the scope of the appended claims.

What is claimed is:

1. A power-driven pincer-type tool holder for use in handling apparatuses comprising:

a socket which may be mounted in a predetermined position on a handling apparatus;

pincer members pivotally mounted about a first axis on said socket, each pincer member including a two-armed lever having a working end and a drive end, each working end having mounting means for a tool member, and each drive end being provided with a cam follower;

a drive unit mounted on said socket, said drive unit including a pressurized fluid cylinder and a piston housed in said cylinder, said cylinder and piston defining a second axis extending substantially orthogonal to said first axis, said piston being in drive connection with a cam head having an individual cam track for each one of said cam followers, each of said cam followers being in engagement with its allocated cam track, and said cam tracks being different from one another so as to impart different movements to said pincer members; and wherein at least one of said cam head or said cam followers are exchangeable to provide a different predetermined displacement of at least one of said levers.

2. The tool holder of claim 1, wherein all levers have a common first axis.

3. The tool holder of claim 2, wherein said socket has a reference axis to be mounted coaxially with respect to a base axis of the handling apparatus, and said reference axis orthogonally intersecting said common first axis.

4. The tool holder of claim 1, wherein said cam followers are spring-biased against their allocated cam tracks.

5. The tool holder of claim 1, wherein the cam head is exchangeable.

* * * * *